US009472879B2

(12) United States Patent
Venaleck et al.

(10) Patent No.: US 9,472,879 B2
(45) Date of Patent: Oct. 18, 2016

(54) HIGH-VOLTAGE RESISTANCE OF A CONNECTOR INTERFACE

(75) Inventors: John T. Venaleck, Painesville, OH (US); Larry Crofoot, Perry, OH (US)

(73) Assignee: Cardioinsight Technologies, Inc., Cleveland, OH (US)

( * ) Notice: Subject to any disclaimer, the term of this patent is extended or adjusted under 35 U.S.C. 154(b) by 39 days.

(21) Appl. No.: 14/115,596

(22) PCT Filed: May 3, 2012

(86) PCT No.: PCT/US2012/036269

§ 371 (c)(1),
(2), (4) Date: Feb. 14, 2014

(87) PCT Pub. No.: WO2012/151370

PCT Pub. Date: Nov. 8, 2012

(65) Prior Publication Data

US 2014/0187099 A1 Jul. 3, 2014

Related U.S. Application Data

(60) Provisional application No. 61/481,854, filed on May 3, 2011.

(51) Int. Cl.

| | |
|---|---|
| ***H01R 13/405*** | (2006.01) |
| ***H01R 13/04*** | (2006.01) |
| ***H01R 24/60*** | (2011.01) |
| ***H01R 12/72*** | (2011.01) |

(Continued)

(52) U.S. Cl.

CPC ..... *H01R 13/04* (2013.01); *H01R 12/727* (2013.01); *H01R 24/60* (2013.01); *H01R 13/28* (2013.01); *H01R 13/405* (2013.01); *H01R 13/53* (2013.01); *H01R 2107/00* (2013.01)

(58) Field of Classification Search

CPC ... H01R 23/02; H01R 13/04; H01R 23/7084
USPC ..... 439/660
See application file for complete search history.

(56) References Cited

U.S. PATENT DOCUMENTS 4,364,626 A * 12/1982 Price ..... H01R 13/28 439/680

(Continued)

FOREIGN PATENT DOCUMENTS

| | | |
|---|---|---|
| EP | 0651919 A1 | 5/1995 |
| EP | 0949715 A2 | 10/1999 |

(Continued)

OTHER PUBLICATIONS

PCT Int'l Search Report and Written Opinion—6 pgs., Nov. 23, 2012, CardioInsight Technologies, Inc.

(Continued)

*Primary Examiner* — Briggitte R Hammond
(74) *Attorney, Agent, or Firm* — Tarolli, Sundheim, Covell & Tummino LLP

(57) ABSTRACT

An electrical connector has dielectric posts surrounding the contacts and extending outwardly from the root along the contact axis a finite amount. The mating connector (or plug) has a housing that surrounds the posts. A device that includes both the electrical connector and the mating connector provides good electrical isolation between adjacent contacts.

18 Claims, 2 Drawing Sheets

(51) Int. Cl.

| | |
|---|---|
| *H01R 107/00* | (2006.01) |
| *H01R 13/28* | (2006.01) |
| *H01R 13/53* | (2006.01) |

(56) References Cited

U.S. PATENT DOCUMENTS

| | | | |
|---|---|---|---|
| 4,605,272 | A | 8/1986 | Myers et al. |
| 5,261,829 | A | 11/1993 | Fusselman et al. |
| 7,445,528 | B1 | 11/2008 | Kuzma |

FOREIGN PATENT DOCUMENTS

| | | | |
|---|---|---|---|
| WO | WO 99/19943 | A1 | 4/1999 |
| WO | WO 02/058191 | A2 | 7/2002 |

OTHER PUBLICATIONS

European Patent Application No. 12779450.1; Supplementary European Search Report, Applicant: CardioInsight Technologies, Inc.; Date of Completion of Search Report Dec. 1, 2014; 5 pgs.

* cited by examiner

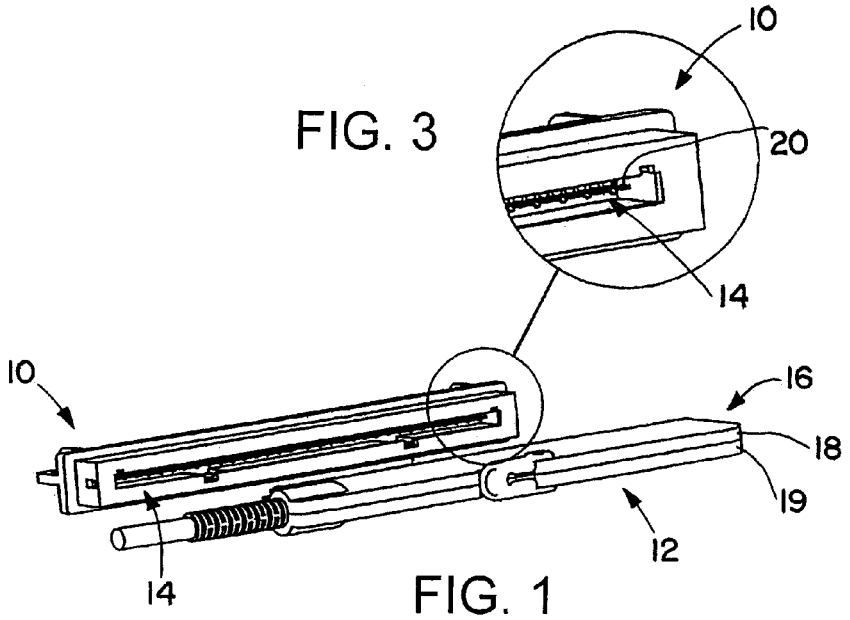
FIG. 3
FIG. 1
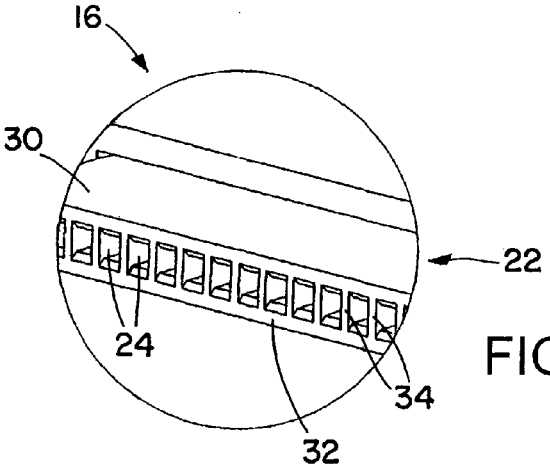
FIG. 4
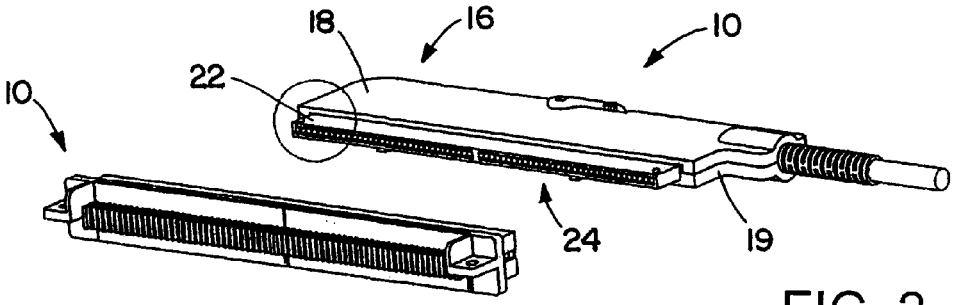
FIG. 2

HIGH-VOLTAGE RESISTANCE OF A CONNECTOR INTERFACE

This application is a U.S. National Stage Application filed under 35 U.S.C. §371 of PCT/US2012/036269, having a filing date of May 3, 2012, which claims the benefit of U.S. Provisional Patent Application No. 61/481,854, filed on May 3, 2011, and entitled HIGH-VOLTAGE RESISTANCE OF A CONNECTOR INTERFACE. The entire contents of each of the above-identified patent applications are incorporated herein by reference.

BACKGROUND

Electrical connector pairs typically have a plug and a receptacle. Electrical contacts within the plug and the receptacle are arranged laterally in close array. The lateral proximity of the contacts are typically too close to allow high voltage between them. It is desirable to provide a connector pair wherein high voltage between contacts will not cause current leakage or voltage breakdown.

SUMMARY OF THE INVENTION

According to one aspect of the invention, both plug and receptacle connectors have rectangular dielectric posts surrounding the contacts and extending outwardly from a root.

According to another aspect of the invention, the plug has a housing with rectangular openings to accept the posts surrounding the contacts.

According to another aspect of the invention, the combination of dielectric posts and rectangular openings in the plug form isolation paths, preventing current leakage and voltage breakdowns when high voltage appears between the contacts.

According to a further aspect of the invention, a combination of a receptacle electrical connector and a plug that mates with the receptacle connector, may include one or more of the following features: the receptacle connector has connector contacts that have dielectric posts surrounding parts of the connector contacts; there are slots between the posts, separating the posts for the individual connector contacts; the plug has a housing with openings that accept the posts when the plug is mated to the connector; the openings are rectangular openings; the housing includes partitions that enter into the slots between the posts when the plug is mated to the connector; the combination of the posts and the partitions form isolation paths, preventing current leakage and voltage breakdowns when high voltage appears between the contacts; the posts are plastic posts; the plastic posts extend from a root that is a continuous molded piece with all of the posts; the posts are integral parts of a molded connector body of the connector; the plug has plug contacts that engage the connector contacts when the plug is mated with the connector; the plug contacts have dielectric posts surrounding parts of the plug contacts; the posts surrounding the plug contacts have slots between them; the posts surrounding the plug contacts are received in the rectangular openings; the partitions of the plug housing are located in the slots between the posts surrounding the plug contacts; and the posts surrounding the plug contacts are integral parts of a continuous unitary molded plastic piece that includes a header that is connected to all of the posts.

According to another aspect of the invention, a device includes: a receptacle electrical connector; and a plug that mates with the receptacle connector. The receptacle connector has connector contacts that have dielectric posts surrounding parts of the connector contacts To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF THE DRAWINGS

The annexed drawings, which are not necessarily to scale, show various features of the invention.

FIG. 1 is an oblique view of a device in accordance with an embodiment of the present invention.

FIG. 2 is another oblique view of the device of FIG. 1.

FIG. 3 is a magnified view of part of a connector of the device of FIG. 1.

FIG. 4 is a magnified view of part of a plug of the device of FIG. 1.

DETAILED DESCRIPTION

Figure 5:
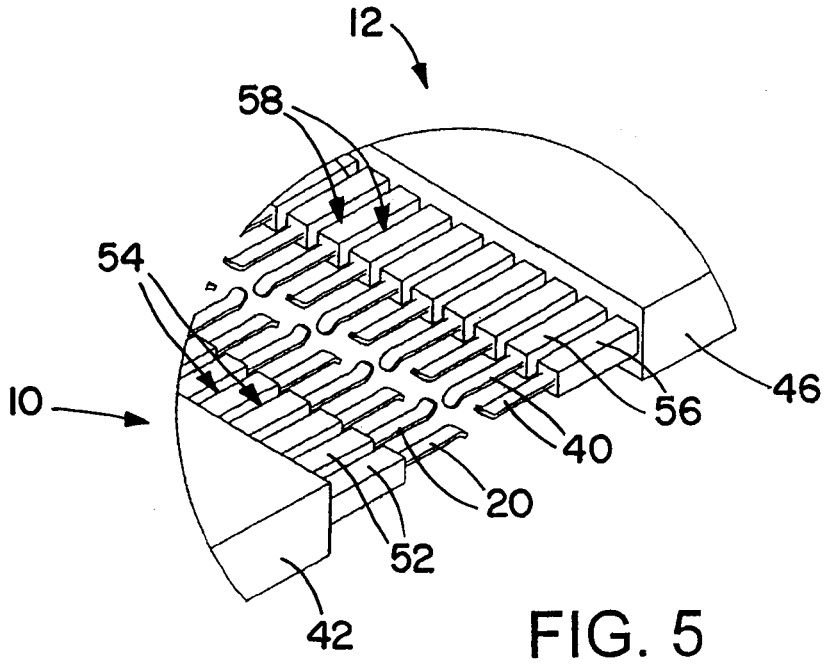
FIG. 5 is an oblique view of part of the device of FIG. 1, with the insert portion of the plug omitted for clarity.

An electrical connector has dielectric posts surrounding the contacts and extending outwardly from the root along the contact axis a finite amount. The mating connector (or plug) has a housing that surrounds the posts. A device that includes both the electrical connector and the mating connector provides good electrical isolation between adjacent contacts.

Referring initially to FIGS. 1 and 2, a device includes a connector or receptacle 10 that is engaged by a mating connector or plug 12. The connector 10 may be a circuit board edge connector configured to engage the edge of a circuit board (not shown). The plug 12 fits into an opening 14 of the connector 10 to engage the connector 10. The plug 12 has a housing 16, part of which is inserted into the opening 14 when the plug is engaged with (mated to) the connector 10. The housing 16 may include a pair of housing halves 18 and 19 that are joined together.

FIGS. 3 and 4 show some further details of the connector 10 and the plug 12. The connector 10 has receptacle contacts 20 within the opening 14. When an insert portion 22 of the plug housing 16 is inserted into the opening 14, the connector contacts 20 are engaged by plug contacts that are located within rectangular openings 24 in the plug insert portion 22. Each of the plug contacts is in a respective rectangular opening 24. The plug contacts within the rectangular openings 24 are surrounded by dielectric material of the plug insert portion 22. All of the rectangular openings 24 share a common top wall 30 and a common bottom wall 32. A series of partitions 34 run from the top wall 30 to the bottom wall 32 to separate the space between the walls 30 and 32 into the individual rectangular openings 24. The partitions 34 and the walls 30 and 32 may all be parts of a single molded plastic piece that defines the rectangular openings 24. The plastic piece is part of the plug housing 16.

Turning now to FIG. 5, the connector contacts 20 are shown just out of engagement with plug contacts 40. The contacts 20 and 40 are illustrated as hermaphroditic contacts, but alternatively may be other types of contacts. The spacing between the connector (receptacle) contacts 20 may be about 0.020 inches, and the plug contacts 40 have the same spacing. The connector contacts 20 are attached to a plastic connector root 42, which may be a part of a connector body of the connector 10 (FIG. 1). The plug contacts 40 are attached to a plastic plug header or root 46, which may be inserted into the plug 12 (FIG. 1) such that the plug contacts 40 extend into the rectangular openings 24 (FIG. 4) of the plug 12.

Plastic posts 52 surround the connector contacts 20 near the connector root 42, where the connector contacts 20 emerge from the connector root 42. The posts 52 extend along contact axes of their respective connector contacts 20. Slots 54 are located between adjacent of the posts 52 (and therefore also adjacent of the connector contacts 20 in the vicinity of the posts 52). Plastic posts 56 similarly surround the plug contacts 40 where the plug contacts 40 emerge from the plug header or root 46. Slots 58 are located between adjacent of the posts 56 (and therefore also adjacent of the plug contacts 40 in the vicinity of the posts 56).

Figure 6:
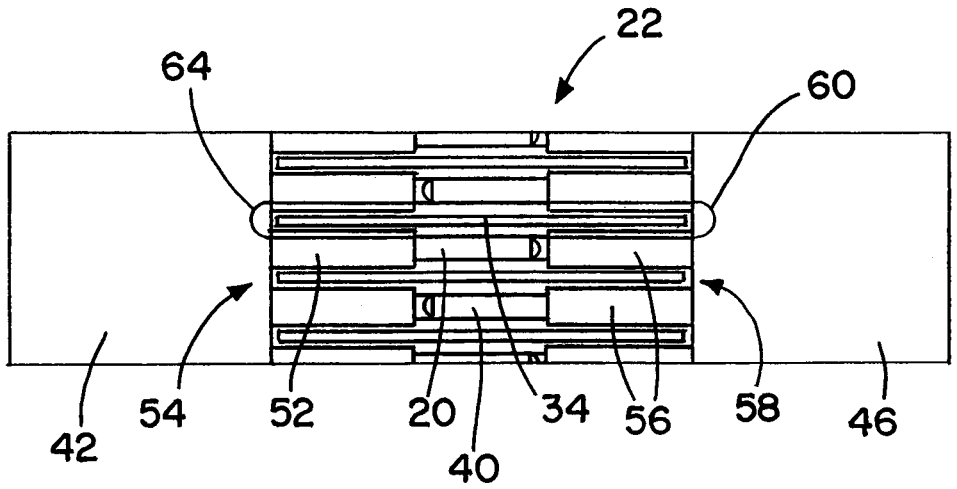
FIG. 6 is a plan view showing engagement of the contacts of the device of FIG. 1.

With reference now to FIG. 6, the plug contacts 40 are shown as inserted into the plug insert portion 22, such as occurs when the plug 12 is assembled. The plug contacts 40 are separated from one another by the partitions 34. The posts 56 also extend into the plug insert portion 22, with the partitions 34 in the slots 58 between the posts 56. The combination of the partitions 34 and the posts 56 electrically isolate the plug contacts 40 from one another. Instead of the gap to be bridged between adjacent plug contacts 40 being the separation distance between the contacts 40, a signal would have to bridge the isolation path 60, which runs past the posts 56 and around the end of the partition 34.

A similar extended isolation path 64 is provided for the connector contacts 20. When the plug 12 is inserted into the connector 10 the ends of the partitions 34 engage the slots 54 between the posts 52. The partitions 34 and the posts 52 combine to increase the isolation path 64 between the connector contacts 20 significantly beyond the spacing of the connector contacts 20. The extended isolation paths 60 and 64 aid in preventing current leakage and voltage breakdowns when high voltage appears between the contacts 20 and 40.

As an alternative all or part of the plug header 46 and/or the posts 56 may be formed as an integral molded part with other portions of the housing of the plug 12.

Many variants are possible regarding the above device and method. For example device may include any suitable number of contacts, as well as various configurations for the contacts.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A device comprising:

a receptacle electrical connector, the receptacle electrical connector comprising connector contacts that have connector dielectric posts surrounding parts of the connector contacts; and a plug that mates with the receptacle connector, the plug comprising a housing that comprises a common top wall and a common bottom wall, the housing further comprising partitions between the common top wall and the common bottom wall to provide openings that accept the connector dielectric posts when the plug is mated to the receptacle electrical connector, each of the openings shares the common top wall and the common bottom wall, wherein the plug has plug contacts that engage the connector contacts when the plug is mated with the receptacle electrical connector.

2. The device of claim 1, wherein slots are located between adjacent connector dielectric posts to separate the adjacent connector dielectric posts from one another.

3. The device of claim 2, wherein the openings are rectangular openings.

4. A device comprising:

a receptacle electrical connector, the receptacle electrical connector comprising connector contacts that have connector dielectric posts surrounding parts of the connector contacts and slots located between adjacent connector dielectric posts to separate the adjacent connector dielectric posts from one another; and a plug that mates with the receptacle connector, the plug comprising a housing with openings sharing a common top wall and a common bottom wall that accept the connector dielectric posts therein and partitions that enter into the slots between the dielectric posts when the plug is mated to the receptacle electrical connector, wherein the plug has plug contacts that engage the connector contacts when the plug is mated with the receptacle electrical connector.

5. The device of claim 4, wherein the combination of the connector dielectric posts and the partitions form isolation paths, preventing current leakage and voltage breakdowns when high voltage appears between the contacts.

6. The device of claim 1, wherein the connector dielectric posts are plastic posts.

7. The device of claim 6, wherein the plastic posts extend from a root that is a continuous molded piece with all of the plastic posts.

8. The device of claim 6, wherein the plastic posts are integral parts of a molded connector body of the receptacle electrical connector.

9. The device of claim 1, wherein the plug contacts have plug dielectric posts surrounding parts of the plug contacts.

10. The device of claim 9, wherein the plug dielectric posts surrounding the plug contacts have slots between adjacent plug dielectric posts.

11. A device comprising:

a receptacle electrical connector, the receptacle electrical connector comprising connector contacts that have connector dielectric posts surrounding parts of the connector contacts; and a plug that mates with the receptacle connector, the plug comprising a housing with openings sharing a common top wall and a common bottom wall that accept the connector dielectric posts therein when the plug is mated to the receptacle electrical connector;

wherein the plug has plug contacts that engage the connector contacts when the plug is mated with the receptacle electrical connector and that have plug dielectric posts surrounding parts of the plug contacts;

wherein the plug dielectric posts surrounding the plug contacts have slots between adjacent plug dielectric posts;

wherein the housing comprises partitions;

wherein the openings in the housing are rectangular openings, the plug dielectric posts surrounding the plug contacts reside in the rectangular openings such that the plug contacts are attached to and extend from a plug root portion into the rectangular openings of the plug; and wherein each partition of the plug housing is located in a respective slot between adjacent plug dielectric posts surrounding respective plug contacts.

12. A device comprising:

a receptacle electrical connector, the receptacle electrical connector comprising connector contacts that have connector dielectric posts surrounding parts of the connector contacts; and a plug that mates with the receptacle connector, the plug comprising a housing with openings sharing a common top wall and a common bottom wall that accept the connector dielectric posts therein when the plug is mated to the receptacle electrical connector;

wherein the plug has plug contacts that engage the connector contacts when the plug is mated with the receptacle electrical connector and that have plug dielectric posts surrounding parts of the plug contacts;

wherein the plug dielectric posts surrounding the plug contacts have slots between adjacent plug dielectric posts; and wherein the plug dielectric posts surrounding the plug contacts are integral parts of a continuous unitary molded plastic piece that includes a header that is connected to all of the plug dielectric posts.

13. The device of claim 1, wherein slots are located between adjacent connector dielectric posts to separate the adjacent connector dielectric posts from one another;

wherein the openings are rectangular openings;

wherein the housing includes partitions that enter into the slots between the connector dielectric posts when the plug is mated to the connector;

wherein the plug contacts have plug dielectric posts surrounding parts of the plug contacts; and wherein the plug dielectric posts surrounding the plug contacts have slots between adjacent posts.

14. The device of claim 1, wherein the partitions run from the common top wall to the common bottom wall to form the openings; and wherein the connector contacts are configured to engage the plug contacts of the plug located within the openings of the plug when the plug is mated with the receptacle electrical connector.

15. A device comprising:

a receptacle electrical connector, the receptacle electrical connector comprising connector contacts that have connector dielectric posts surrounding parts of the connector contacts with a free contact portion of the connector contacts extending axially beyond respective dielectric posts; and a plug that mates with the receptacle electrical connector, the plug comprising:

plug contacts that include plug dielectric posts surrounding parts of the plug contacts with a free contact portion of the plug contacts extending axially beyond respective dielectric posts; and a housing having openings, the plug contacts extend from a root portion of the housing into the openings to terminate in a distal end of free portion of the plug contacts located within respective openings, the openings configured to accept the connector dielectric posts therein when the plug is mated to the receptacle electrical connector, wherein, when the plug is mated to the receptacle electrical connector, ends of the connector dielectric posts are spaced axially from corresponding ends of the plug dielectric posts by a distance that is at least a length of the free contact portion of a given connector contact or a given plug contact.

16. The device of claim 15, wherein the plug dielectric posts surrounding the plug contacts have slots between adjacent plug dielectric posts; and wherein the housing comprises partitions running from the common top wall to the common top wall to form the openings, each slot is configured to receive a partition.

17. The device of claim 16, wherein the connector dielectric posts surrounding the connector contacts have slots between adjacent connector dielectric posts such that when the plug is mated with the receptacle electrical connector, ends of the partitions engage the slots between the connector dielectric posts.

18. The device of claim 15, wherein the connector dielectric posts are integral parts of a molded connector body of the receptacle electrical connector; and wherein the plug dielectric posts are integral parts of a continuous unitary molded plastic piece that includes a header that is connected to all of the plug dielectric posts.

* * * * *